US009869010B2

(12) United States Patent
Kim et al.

(10) Patent No.: US 9,869,010 B2
(45) Date of Patent: Jan. 16, 2018

(54) TIN-CONTAINING AMORPHOUS ALLOY

(75) Inventors: Choongnyun Paul Kim, Rancho Santa Margarita, CA (US); Theodore A. Waniuk, Lake Forest, CA (US); Quoc Tran Pham, Anaheim, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 407 days.

(21) Appl. No.: 13/704,537

(22) PCT Filed: Jun. 13, 2011

(86) PCT No.: PCT/US2011/040147
§ 371 (c)(1),
(2), (4) Date: Feb. 12, 2013

(87) PCT Pub. No.: WO2011/159596
PCT Pub. Date: Dec. 22, 2011

(65) Prior Publication Data

US 2013/0133787 A1 May 30, 2013

Related U.S. Application Data

(60) Provisional application No. 61/354,620, filed on Jun. 14, 2010.

(51) Int. Cl.
*C22C 45/10* (2006.01)
*C22C 1/00* (2006.01)
(Continued)

(52) U.S. Cl.
CPC ..... *C22C 45/10* (2013.01); *C22C 1/002* (2013.01); *C22C 14/00* (2013.01); *C22C 16/00* (2013.01);
(Continued)

(58) Field of Classification Search
None
See application file for complete search history.

(56) References Cited

U.S. PATENT DOCUMENTS 5,288,344 A 2/1994 Peker
5,368,659 A 11/1994 Peker
(Continued)

FOREIGN PATENT DOCUMENTS

CN 1403619 3/2003
CN 101010440 8/2007
(Continued)

OTHER PUBLICATIONS

ASM Handbook, vol. 2: Properties and Selection: Nonferrous Alloys and Special-Purpose Materials, "Preparation and Characterization of Pure Metals", ASM, 1990, pp. 1093-1097.*
(Continued)

*Primary Examiner* — George Wyszomierski
(74) *Attorney, Agent, or Firm* — Brownstein Hyatt Farber Schreck, LLP

(57) ABSTRACT

One embodiment provides a composition, the composition comprising: an alloy that is at least partially amorphous and is represented by a chemical formula: $(Zr, Ti)_aM_bN_cSn_d$, wherein: M is at least one transition metal element; N is Al, Be, or both; a, b, c, and d each independently represents an atomic percentage; and a is from about 30 to 70, b is from about 25 to 60, c is from about 5 to 30, and d is from about 0.1 to 5.

20 Claims, 1 Drawing Sheet

(51) Int. Cl.

| | |
|---|---|
| ***C22C 14/00*** | (2006.01) |
| ***C22C 16/00*** | (2006.01) |
| ***C22F 1/18*** | (2006.01) |
| ***C22C 45/00*** | (2006.01) |

(52) U.S. Cl.
CPC ..... *C22C 45/001* (2013.01); *C22C 45/003* (2013.01); *C22F 1/183* (2013.01); *C22F 1/186* (2013.01); *C21D 2201/03* (2013.01)

(56) References Cited

U.S. PATENT DOCUMENTS

| | | | | |
|---|---|---|---|---|
| 5,618,359 | A | 4/1997 | Lin | |
| 5,735,975 | A | 4/1998 | Lin | |
| 6,325,868 | B1 | 12/2001 | Kim | |
| 7,147,727 | B2 * | 12/2006 | Kim et al. | 148/403 |
| 7,591,910 | B2 * | 9/2009 | Xu et al. | 148/403 |
| 2008/0090521 | A1 | 4/2008 | Shin | |
| 2009/0139612 | A1 | 6/2009 | Lu | |
| 2009/0288741 | A1 | 11/2009 | Zhang | |
| 2010/0084052 | A1 | 4/2010 | Farmer | |

FOREIGN PATENT DOCUMENTS

| | | |
|---|---|---|
| CN | 101538690 | 9/2009 |
| EP | 1632584 | 3/2006 |
| EP | 2103699 | 9/2009 |
| JP | 11009741 | 1/1999 |
| JP | H11071661 | 3/1999 |
| JP | 2001-303218 | 10/2001 |
| KR | 1020060098035 | 9/2006 |

OTHER PUBLICATIONS

Inoue et al, "Bulk amorphous alloys with high mechanical strength and good soft magnetic properties in Fe—Tm—B (Tm=IV-VIII group transition metal) system", Appl. Phys. Lett., vol. 71, p. 464 (1997).

Shen et al, "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

Kim et al, "Glass forming ability and crystallization behavior of Ti-based amorphous alloys with high specific strength", Journal of Non-Crystalline Solids', Sep. 15, 2003, pp. 242-250, vol. 325, No. 1-3.

Pasko et al, "Synthesis and characterization of amorphous Zr-based alloys with Ta and W additions", Journal of Alloys and Compounds, Aug. 26, 2009, pp. 120-124, vol. 483, No. 1-2.

Wang et al, "Thermodynamic characteristics of Ti-based glass forming alloys", Jounral of Non-Crystalline Solids, Jun. 15, 2009, pp. 986-990, vol. 355, No. 16-17.

Oak et al, "Investigation of glass-forming ability, deformation and corrosion behavior of Ni-free Ti-based BMG alloys designed for application as dental implants", Material Science and Engineering C, Jan. 1, 2009, pp. 322-327, vol. 29, No. 1.

Wang et al, "Glass formation ability and mechanical properties of Ti40Cu40Zr10Ni10 alloy", Journal of Non-Crystalline Solids, Jul. 15, 2008, pp. 3653-3658, vol. 354, No. 30.

Kim et al, "Synthesis of bulk metallic glass in the Ti-rich part of the Ti—Cu—Ni—Sn—Be—Zr alloy system", Annales De Chimie, Sep. 1, 2002, pp. 11-17, vol. 27, No. 5.

Kim et al, "A development of Ti-based bulk metallic glass", Materials Science and Engineering A: Structural Materials: Properties, Microstructure & Processing, Jul. 15, 2004, pp. 127-135, vol. 375-377.

Medhat et al, "Characterization of strengthened rapidly quenched Zr-based alloys", International Journal of Mechanics and Materials in Design, Mar. 7, 2008, pp. 279-289, vol. 4, No. 3.

Park et al, "Development of new Ni-based amorphous alloys containing no metalloid that have large undercooled liquid regions", Scripta Materialia, May 3, 2000, pp. 109-114, vol. 43, No. 2.

State Intellectual Property Office of the People's Republic of China, Chinese Application No. 201180037377.9, dated Apr. 28, 2014.

International Search Report dated Aug. 22, 2011, PCT/US2011/040147, 6 pages.

* cited by examiner

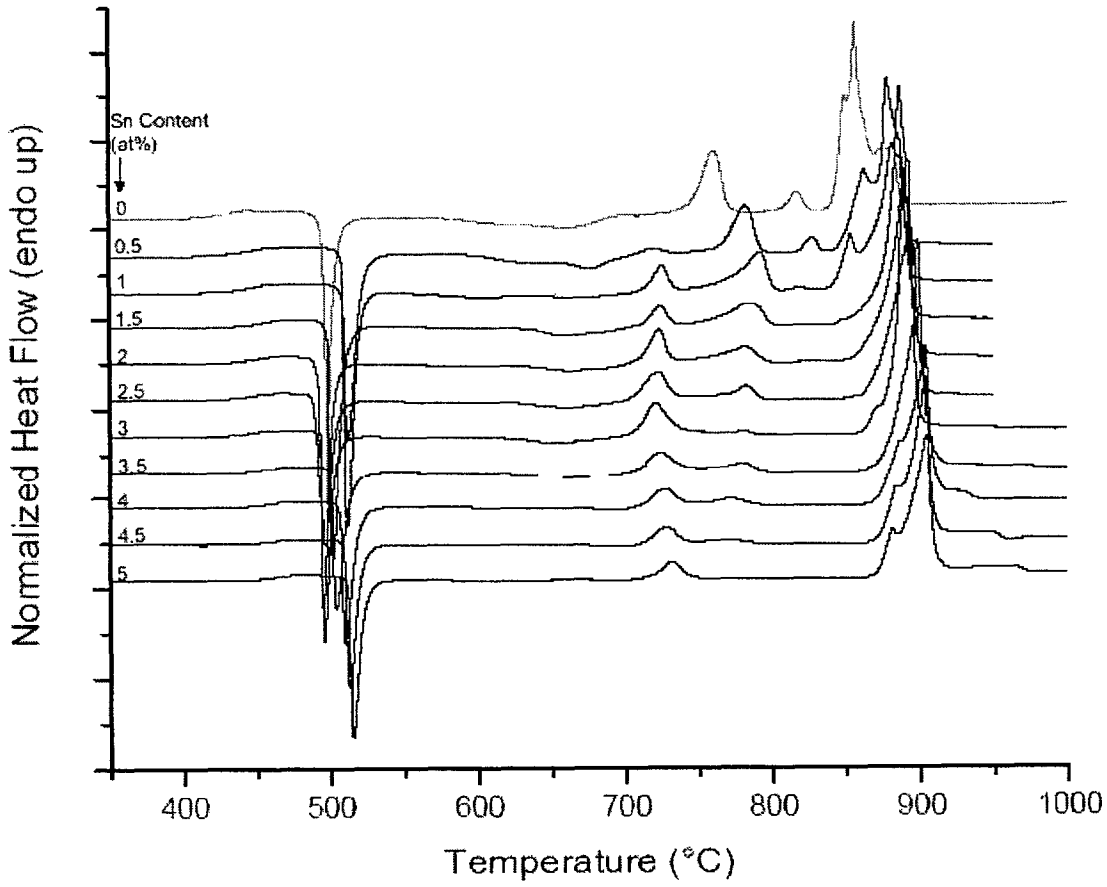
Sn Content (at%)
0
0.5
1
1.5
2
2.5
3
3.5
4
4.5
5
400
500
600
700
800
900
1000
Temperature (°C)
Normalized Heat Flow (endo up)

TIN-CONTAINING AMORPHOUS ALLOY

CROSS REFERENCE TO RELATED APPLICATIONS

This is the U.S. National Phase of PCT/US2011/040147, filed Jun. 13, 2011, which in turn claims priority to U.S. Provisional Application No. 61/354,620, filed Jun. 14, 2010, the contents of both of which are incorporated herein in their entirety by reference.

All publications, patents, and patent applications cited in this Specification are hereby incorporated by reference in their entirety.

BACKGROUND

Bulk-solidifying amorphous alloy compositions have been discovered within a variety of alloy systems. These materials are typically prepared by quenching a molten alloy from above the melt temperature to ambient temperature. Generally, cooling rates of $10^{5}$° C./sec or lower have been employed to achieve an amorphous structure. Until the early nineties, the process-ability of conventional amorphous alloys was quite limited, and conventional amorphous alloys were readily available only in powder form or in very thin foils or strips with critical dimensions of less than 100 micrometers. In the early nineties, a new class of Zr- and Ti-based amorphous alloys was developed; these alloys had critical cooling rates less than $10^{3}$° C./sec, and in some cases as low as 10° C./sec, much lower than comparable alloy systems discovered up to that point. Bulk-solidifying amorphous alloys have very high strength, high specific strength, high elastic strain limit, and an unusual combination of other engineering properties.

Amorphous alloys and their in-situ composites generally need high purity constituent elements to achieve optimum mechanical and thermal properties. However, the need for high purity elements limits the number of re-melting and recycling steps to which the alloys can be subjected. This not only increases the cost of manufacturing, but also increases the waste and environmental pollution associated with such manufacturing.

Accordingly, there is a need to develop a new class of engineering alloys that exhibit the same thermal and mechanical properties (e.g., high yield strength, high hardness, high ductility and toughness), yet have a reduced manufacturing cost and environmental impact.

SUMMARY

One embodiment provides a composition, the composition comprising: an alloy that is at least partially amorphous and is represented by a chemical formula: $(Zr, Ti)_aM_bN_cSn_d$, wherein: M is at least one transition metal element; N is Al, Be, or both; a, b, c, and d each independently represents an atomic percentage; and a is from about 30 to 70, b is from about 25 to 60, c is from about 5 to 30, and d is from about 0.1 to 5.

Another embodiment provides a method of making an alloy, comprising: providing a molten mixture of the alloy at a first temperature above a glass transition temperature Tg of the alloy, the mixture comprising elements Q, M, N, Sn; quenching the mixture to a second temperature below the Tg to form an alloy that is at least partially amorphous and is represented by a chemical formula: $(Zr, Ti)_aM_bN_cSn_d$, wherein: Q is Zr, Ti, or both; M is at least one transition metal element; N is Al, Be, or both; a, b, c, and d each independently represents an atomic percentage; and: a is from about 30 to 70, b is from about 25 to 60, c is from about 5 to 30, and d is from about 0.1 to 5.

An alternative embodiment provides a composition, comprising: an amorphous alloy that is represented by a chemical formula: $Q_aM_bN_cSn_d$, wherein: Q is Zr, Ti, or both; M is at least one transition metal element; N is Al, Be, or both; a, b, c, and d each independently represents an atomic percentage; and: a is from about 30 to 70, b is from about 25 to 60, c is from about 5 to 30, and d is from about 0.1 to 5; and wherein the alloy is made with a mixture comprising the Q at a purity level of 99% or less.

One embodiment provides amorphous alloys or alloy composite metals comprising ductile crystalline metal particulates in an amorphous alloy matrix; wherein the alloys can, for example, comprise tin.

Another embodiment provides amorphous alloys and/or their in-situ composites having a small amount of Sn added thereto, wherein the alloys or the composites can be prepared with low purity constituent elements. In one embodiment, about 0.5 to 4.5 atomic percent tin is added to the amorphous alloy or in-situ composite amorphous alloy.

Another embodiment provides amorphous alloys and/or composite metals comprising ductile crystalline metal particles in an amorphous metal matrix that contain a concentration of tin. Methods of improving the processability of amorphous alloys containing low purity materials by the addition of tin without reducing the mechanical and thermal properties of amorphous alloys are also provided.

BRIEF DESCRIPTION OF THE DRAWINGS

FIG. 1 shows DSC profiles of a series of amorphous alloys with different Sn content in one embodiment.

DETAILED DESCRIPTION

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase. As will be discussed below, a "crystalline phase" can be characterized by the presence of at least one crystal.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and serve as transitional links between the most and the least electropositive elements in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy composition can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, C, Si, Ge, and B. The nonmetal elements in one embodiment can also refer to post-transition metal elements, which are sometimes known as "poor metals." These elements can include certain elements in Groups 12-15, including Zn, Cd, Hg, Ga, In, Tl, Sn, Pb, and Bi. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy composition can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. In one embodiment wherein an ultrasonic measurement is used, the alloy sample can have a shape of a parallelepiped. The particulate can have any suitable size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" in one embodiment refers to two or more substances, which may be solids, liquids, gases, or a combination of these, mixed and/or dissolved within and/or by one another. The mixture can be homogeneous or heterogeneous. The term "mixture" is a composition of two or more substances that are combined with each other and are generally capable of being separated. Generally, the two or more substances are not chemically combined with each other.

Amorphous or Non-Crystalline Solid

An "amorphous" or "non-crystalline solid" is a solid that lacks lattice periodicity, which is characteristic of a crystal. As used herein, an "amorphous solid" includes "glass" that is an amorphous solid that softens and transforms into a liquid-like state upon heating through the glass transition. Generally, amorphous materials lack the long-range order characteristic of a crystalline material, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" in one embodiment designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. The phase with the presence of at least one crystal can be referred to as a "crystalline" phase. For example, the alloy sample/specimen can include at least some crystallinity, with grains/ crystals having sizes in the nanometer and/or micrometer ranges. Alternatively, the alloy can be substantially amorphous, such as fully amorphous. In one embodiment, the alloy sample composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be "amorphicity." Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structure in thick layers—e.g., bulk metallic glasses.

The terms "bulk metallic glass" ("BMG"), bulk amorphous alloys, and bulk solidifying amorphous alloys are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials, in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more constituents, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metal elements (iron, cobalt, nickel) may be magnetic, with low coercivity and high electrical resistance. The high resistance leads to low losses by eddy currents when subjected to alternating magnetic fields, a property useful, for example, as transformer magnetic cores. Alternatively, due to the isotropic nature of the amorphous alloys, in some embodiments some of the amorphous alloys containing magnetic metal elements as constituents can be overall non-magnetic.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one metallic glass, known as Vitreloy™, has a tensile strength that is almost twice that of high-grade titanium. In some embodiments, metallic glasses at room temperature are not ductile and tend to fail suddenly when loaded in tension, which can affect the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tends to cause embrittlement (e.g., Ni) can be used. For example, a Ni-free BMG can be used to improve the ductility of the BMG.

Another useful property of bulk amorphous alloys is that they can be true glasses; in other words, they can soften and flow upon heating. This allows for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction or weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or different chemical composition. In one embodiment, they can have substantially the same chemical composition. In another embodiment, the crystalline phase can be more ductile than the BMG phase.

The methods described herein can be applicable to any type of amorphous alloys. Similarly, the amorphous alloys described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. In some embodiments, the alloy, or the composition including the alloy, can be substantially free of nickel, aluminum, or beryllium, or combinations thereof. The alloy can also be free of any of the other aforementioned elements, depending on the application for which the alloy is intended. In one embodiment, the alloy or the composite is completely free of nickel, aluminum, or beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™ such as Vitreloy-1 and Vitreloy-101, as fabricated by Liquidmetal Technologies, CA, USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368, 659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition consists of the amorphous alloy (with no observable trace of impurities).

TABLE 1

Exemplary amorphous alloy compositions

| Alloy | Atm % | Atm % | Atm % | Atm % | Atm % | Atm % |
|---|---|---|---|---|---|---|
| 1 | Zr<br>41.20% | Ti<br>13.80% | Cu<br>12.50% | Ni<br>10.00% | Be<br>22.50% | |
| 2 | Zr<br>44.00% | Ti<br>11.00% | Cu<br>10.00% | Ni<br>10.00% | Be<br>25.00% | |
| 3 | Zr<br>56.25% | Ti<br>11.25% | Cu<br>6.88% | Ni<br>5.63% | Nb<br>7.50% | Be<br>12.50% |
| 4 | Zr<br>64.75% | Ti<br>5.60% | Cu<br>14.90% | Ni<br>11.15% | Al<br>2.60% | Be<br>1.00% |
| 5 | Zr<br>52.50% | Ti<br>5.00% | Cu<br>17.90% | Ni<br>14.60% | Al<br>10.00% | |
| 6 | Zr<br>57.00% | Nb<br>5.00% | Cu<br>15.40% | Ni<br>12.60% | Al<br>10.00% | |

TABLE 1-continued

Exemplary amorphous alloy compositions

| Alloy | Atm % | Atm % | Atm % | Atm % | Atm % | Atm % |
|---|---|---|---|---|---|---|
| 7 | Zr<br>50.75% | Cu<br>36.23% | Ni<br>4.03% | Al<br>9.00% | Sn<br>0.50% | |
| 8 | Zr<br>46.75% | Ti<br>8.25% | Cu<br>7.50% | Ni<br>10.00% | Be<br>27.50% | |
| 9 | Zr<br>21.67% | Ti<br>43.33% | Ni<br>7.50% | Be<br>27.50% | | |
| 10 | Zr<br>35.00% | Ti<br>30.00% | Cu<br>7.50% | Be<br>27.50% | | |
| 11 | Zr<br>35.00% | Ti<br>30.00% | Co<br>6.00% | Be<br>29.00% | | |
| 12 | Au<br>49.00% | Ag<br>5.50% | Pd<br>2.30% | Cu<br>26.90% | Si<br>16.30% | |
| 13 | Au<br>50.90% | Ag<br>3.00% | Pd<br>2.30% | Cu<br>27.80% | Si<br>16.00% | |
| 14 | Pt<br>57.50% | Cu<br>14.70% | Ni<br>5.30% | P<br>22.50% | | |
| 15 | Zr<br>36.60% | Ti<br>31.40% | Nb<br>7.00% | Cu<br>5.90% | Be<br>19.10% | |
| 16 | Zr<br>38.30% | Ti<br>32.90% | Nb<br>7.30% | Cu<br>6.20% | Be<br>15.30% | |
| 17 | Zr<br>39.60% | Ti<br>33.90% | Nb<br>7.60% | Cu<br>6.40% | Be<br>12.50% | |
| 18 | Cu<br>47.00% | Ti<br>34.00% | Zr<br>11.00% | Ni<br>8.00% | | |
| 19 | Zr<br>55.00% | Co<br>25.00% | Al<br>20.00% | | | |

Tin-Containing Alloy

One embodiment is directed to a new class of tin-containing engineering alloys with desirable mechanical properties, e.g., high yield strength, high hardness, high ductility and toughness, but that may be formed using constituent components of a lower purity relative to pre-existing alloy fabrication technique, thereby allowing for the reduction of manufacturing costs and pollution from their manufacture.

One embodiment herein provides an alloy composition that is at least partially amorphous, such as at least substantially amorphous, such as entirely amorphous. The alloy can be a tin-containing alloy. In one embodiment, the alloy can be represented by a chemical formula $Q_aM_bN_cSn_d$, wherein a, b, c, and d each independently represents an atomic percentage. Depending on the context, the percentage can also refer to volume percentage or weight percentage. Q can be at least one transition metal element; the transition metal element can be any of the transition metal elements aforedescribed. In one embodiment, Q can be Zr, Ti, or both. In such a case, the alloy can be represented by the chemical formula $(Zr, Ti)_aM_bN_cSn_d$. For example, the chemical formula can be $Zr_aM_bN_cSn_d$ or $Ti_aM_bN_cSn_d$.

M can be at least one transition metal element, such as any of the aforedescribed transition elements. In one embodiment, M can be Ni, Co, Cu, Ti, Nb, V, Ta, Mo, W, or combinations thereof. Either Q or M can be one, two, three, four, or more transition metal elements. N can be a metal element. In one embodiment, N can be Al, Be, or both. In one embodiment, M can be Ti, Cu, Nb, Ni, V, Ta, Cu, Mo, or combinations thereof; and while N can be Be. Alternatively, M can be Ti, Cu, Nb, Ni, V, Ta, Cu, Mo, or combinations thereof; and while N can be Al. In one embodiment, M can be Ni, Cu, or both; while N can be Al. In another embodiment, M can be Ni, Cu, or both; while N can be Be. In one embodiment, M can be Zr, V, or both; while N can be Be. In one embodiment, M can be Zr, V, or both; while N can be Al.

The percentage a can be from about 20 to about 80, such as from about 30 to about 70, such as from about 40 to about 60, from about 45 to about 55. The percentage b can be from about 20 to about 70, such as from about 25 to about 60, such as from about 30 to about 50, such as from about 35 to about 45. The percentage c can be from about 1 to about 40, such as from about 5 to about 30, such as from about 10 to about 25, such as from about 15 to about 20. The percentage d can be from about 0.01 to about 10, such as from about 0.5 to about 8, such as from about 0.1 to about 5, such as from about 0.5 to about 3, such as from about 1 to about 2. In one embodiment, a is from about 30 to 70, b is from about 25 to 60, c is from about 5 to 30, and d is from about 0.1 to 5. In one alternative embodiment, a is from about 40 to 70, b is from about 25 to 60, c is from about 5 to 30, and d is from about 0.5 to 4.5. In one embodiment, the alloy is $Zr_{50.75-x}Cu_{36.25}Ni_4Al_9Sn_x$, wherein x represents an atomic percentage and x is from about 0.01 to about 5, such as about 0.02 to about 2, such as 0.05 to about 1, such as 0.1 to about 0.5. In one embodiment, an x of 0.01% can be translated into about 160 ppm Sn. In another embodiment, an x of 0.05% can be translated into about 800 ppm Sn. In this embodiment, Sn is added at the expense of a main transition metal element—i.e., Zr. The main transition metal element need not be limited to Zr, and instead can be any main metal element in an alloy system, depending on the chemistry.

Alternatively, the alloy composition can be in the form of a composite. As aforedescribed, the composition can comprise an amorphous alloy matrix with a separate crystalline phase therein. The crystalline phase can be any of the aforementioned shapes and sizes. The matrix and the crystalline phase can have substantially the same chemical composition or different compositions. In one embodiment, they both contain the aforedescribed $Q_aM_bN_cSn_d$ alloy.

One surprising advantage of the presently described alloys is that the purity of the raw material elements used to make the alloys need not be as high as conventional alloys, or even pre-existing bulk amorphous alloys. One benefit thereof is the tremendous reduction of production cost, as the need for a high purity raw material tends to increase the production cost.

In one embodiment of a zirconium based alloy system, the addition of Sn allows the presently described alloys to have an at least partially amorphous structure, such as at least substantially amorphous structure, such as entirely amorphous structure, while reducing the purity of zirconium needed as a raw material element. The purity described herein refers to the raw material before being mixed and made into an alloy. For example, the Zr element used to make a Zr-based amorphous alloy can have a purity of about 99.50% or lower, such as about 99.00% or lower, such as about 98.75% or lower, such as about 98.50% or lower, such as about 98.25% or lower, such as about 98.00% or lower, such as about 97.50% or lower, such as about 97.00% or lower, such as about 96.50% or lower, such as about 96.00% or lower, such as such as about 95.50% or lower, such as such as about 95.00% or lower. In one embodiment, the Zr purity needed can be further reduced by substituted additional Zr with element such as Hf. In one embodiment, a Zr-based alloy system in the from of a sponge can have the purity of Zr raw material element be lower than 95% as a result of the addition of Hf and/or Sn.

The purity-lowering capability of Sn-addition need not be limited to a Zr-based alloy system. In one embodiment of a titanium based alloy system, the addition of Sn similarly allows the need of a high purity titanium needed as a raw material element. For example, the Ti used to make Ti-based amorphous alloy can also have the aforedescribed purity level. Alternatively, the system can also be a Zr—X alloy system, where X can be a transition metal, such as Cu, Ni, Co, and/or Fe. Alternatively, X can be an alkaline element such as Be. In one embodiment, the alloy system can be a Zr-based Zr—X—Be alloy system. The aforedescribed purity ranges can be applicable to any of the Q, M, N elements in aforedescribed alloy with the formula $Q_aM_bN_cSn_d$. In one embodiment, the ranges can be applicable to the Q element.

In addition to reducing the need of a high purity raw metal element, the addition of Sn can also increase the impurity tolerance of the resultant amorphous alloy system. In other words, the alloy system can have an at least partially amorphous, such as at least substantially amorphous, such as entirely amorphous, microstructure, while unexpectedly having a higher level of impurity present therein than pre-existing amorphous alloys. The impurity can refer to any commonly observed impurities, such as non-metallic and/or non-metalloid impurities, including N, C, H, O, etc. In one embodiment, Sn can be referred to as an impurity as well.

The impurity can be present in elemental form (e.g., Sn), molecular form (e.g., gaseous nitrogen), compound form (e.g., carbide), or combinations thereof. The impurity atoms can be interstitial and/or substitutional atoms in the materials. For example, the presently described alloy systems can have an oxygen content of greater or equal to about 100 ppm, greater or equal to about 200 ppm, greater or equal to about 300 ppm, greater or equal to about 400 ppm, greater or equal to about 600 ppm, greater or equal to about 650 ppm, greater or equal to about 800 ppm, greater or equal to about 1000 ppm, greater or equal to about 1200 ppm, greater or equal to about 1500 ppm, greater or equal to about 1800 ppm, greater or equal to about 2000 ppm, greater or equal to about 2200 ppm, greater or equal to about 2500 ppm, greater or equal to about 2800 ppm, greater or equal to about 3000 ppm, greater or equal to about 3200 ppm, greater or equal to about 3500 ppm, greater or equal to about 3800 ppm, greater or equal to about 4000 ppm, greater or equal to about 4200 ppm, greater or equal to about 4500 ppm, greater or equal to about 4800 ppm, greater or equal to about 5000 ppm.

Not to be bound by any particular theory, but the inclusion of oxygen can adversely impact upon the glass forming ability (GFA) of several BMG system, such as a Zr-based system or a Zr-containing alloy system. However, the impact of the oxygen addition can depend on the several factors, such as the chemistry of the alloy system and/or desired cast alloy section thickness, as well as the tolerance for crystallinity. For example, in a BMG not containing Be (aside from as an incidental impurity), the addition of Sn can allow fabrication of a BMG rod of 0.5 mm diameter with 100% amorphicity with about 650 ppm oxygen. In another embodiment, a BMG rod of 0.5 mm diameter with at least about 97% amorphicity with about 1200 ppm oxygen can be made. In another embodiment, a BMG rod of 0.5 mm diameter with at least about 65% amorphicity with about 3200 ppm oxygen can be made. Alternatively, in an embodiment wherein the BMG comprises a Be-containing alloy, the oxygen content can be, for example, between about 3000 ppm and about 4000 ppm while the alloy is at least partially amorphous and has a fairly large section thickness.

Even with the presence of impurities, the presently described Sn-containing alloy systems can have the superior mechanical, chemical, and microstructural properties of a BMG. For example, the Sn-containing alloys can have the aforedescribed elastic limit, such as at least 1.5%, such as at least 1.8%, such as at least 2.0%. The alloys can have a high hardness of at least 4.5 GPa, such as at least 5.5 GPa, such as at least 6.5 GPa, such as at least 7.5 GPa, such as at least 8 GPa, such as at least 10 GPa. In one embodiment, the hardness can be at least about 532 Vickers and/or 51 Rockwell hardness.

In one embodiment, the alloys can also have a fracture toughness of at least about 20 MPa√m, such as at least about 40 MPa√m, such as at least about 60 MPa√m, such as at least about 80 MPa√m, such as at least about 90 MPa√m, such as at least about 100 MPa√m. The Sn-containing BMG system can be of different chemistries. For example, the alloy can be a Zr—Cu—Ni—Al alloy system. Alternatively, the alloy can be a Zr—Ti—Cu—Be alloy system.

The alloys described herein can have a compressive yield strength of at least about 1.5 MPa, such as at least about 1.8 MPa, such as at least about 2.0 MPa, such as at least about 2.5 MPa. In one embodiment, the alloys described herein can have ductility in compression ranging from about 0.5% to about 5%, such as from about 1% to about 3%. The alloys can also be, for example, resistant to wear and corrosion.

Making of the Alloys

The presently described alloy systems can be fabricated by any of the known methods suitable to produce amorphous alloys. In one embodiment, a method of making an alloy is provided, the method comprising: providing a molten mixture of the alloy at a first temperature above a glass transition temperature Tg of the alloy, and quenching the mixture to a second temperature below Tg to form an alloy that is at least partially amorphous. The quenching rate can vary depending on the alloy system.

The mixture can be a mixture of different material elements Q, M, N, Sn, wherein Q is Zr, Ti, or both; M is at least one transition metal element; and N is Al, Be, or both. In one embodiment, the different elements in the mixture are not bound to one another chemically; one example of such a mixture is different powders of the elements mixed together. In another embodiment, some of the elements in the mixture are bound to one another chemically. Thus, an additional step of alloying at least some of these elements can be applied. Any known alloying techniques can be applied—e.g., atomization, melting, etc.

In an embodiment, alloy ingots are prepared by melting a mixture of raw material elements. The elements can be any of the aforedescribed elements. The melting of the mixture to produce at least one alloy ingot can be sometimes referred to as alloying. As aforedescribed, the addition of Sn surprisingly can relax the need for high purity raw material elements, including those for Q element. The ranges of purity level that can be tolerated are described above. The mixture in the process of making can also be pre-heated—for example it can come in a pre-heated molten state, instead of being heated from a lower temperature. Alternatively, the molten alloy can be pre-formed alloy feedstock. The feedstock can comprise the alloy that is partially amorphous, substantially amorphous, or fully amorphous. The feedstock can also be in any shapes or sizes. For example, the feedstock can comprise preformed alloy ingots.

The first temperature can be one that is above a glass transition temperature Tg of the alloy. For example, the first temperature can be even above the crystallization temperature, Tx, or melting temperature Tm of the alloy. In one embodiment, the ingots may be prepared by arc-melting or inductively melting elemental metals which can be cast into a suitable shape, size, depending on the application. Any pre-existing suitable casting, forming, and/or melting technique can be utilized. The resultant alloy can have at least one dimension that is greater than the critical casting thickness thereof.

The value of Tg, Tm, and Tx can depend on the alloy system. For example, in a zirconium-based alloy system, Tg can be between about 300° C. and about 500° C., such as between about 350° C. and about 450° C., between about 400° C. and about 450° C. One effect of the addition of Sn into an amorphous alloy system can be to shift the value of Tg, thereby affecting the glass forming ability and/or thermal stability.

Not to be bound by any particular theory, but the shift of Tg can alter the reduced glass transition temperature, defined as a ratio of Tg and the liquidus temperature; an increase in the reduced glass transition temperature can be associated with improvement in glass forming ability. Surprisingly, the addition of Sn in one embodiment, wherein the alloy system is a Zr-based system, can result in an increase of Tg and then a decrease of Tg with increasing Sn. In this embodiment, this non-monotonic behavior can occur when the Sn content is between about 0.01 and about 10 atomic percentage, such as between about 0.1% and about 5%.

Casting

The formed amorphous alloys can be further cast and/or shaped into a part. Any suitable forming and casting methods can be utilized. For example, a thermoplastic forming method can be employed. The resultant cast alloys can have at least one dimension that is greater than the critical casting dimension/thickness thereof. The cast alloys can also have a near-net shape. The part herein can refer to a part of a structural component of, for example, a device, such as an electronic device. Examples of electronic devices are further discussed below.

The alloy to be cast in this embodiment need not be amorphous. In one embodiment, the feedstock is at least partially crystalline, such as at least substantially crystalline, such as completely crystalline. The alloy to be cast can be in any shape or form. For example, it can be sheet-like, flake-like, rod-like, wire-like, particle-like, or anything in between. The techniques of making amorphous alloy from crystalline alloys are known, and any of the known methods can be employed hereinto to fabricate the composition. Although different examples of method of forming are described here, other similar forming processes or combinations of such can also be used. For example, the TTT diagram can be utilized to determine a suitable cooling rate and/or a temperature to heat the feedstock to before the feedstock is quenched. The provided sheets, shot, or any shape feedstock can have a small critical casting thickness, but the final part can have thickness that is either thinner or thicker than the critical casting thickness.

Thermoplastic Forming

In one embodiment, the composition can then be heated to a first temperature that is below the crystallization temperature Tx of the composition. This heating step can function as to soften the amorphous alloy without reaching the onset of crystallization (or melting). The first temperature can be slightly below the Tg, at the Tg, or above the Tg of the composition. In other words, the composition can be heated to (1) below the supercooled region or (2) within the supercooled region. In some embodiments, the composition can also be heated to be above the supercooled region. In one embodiment, the first temperature is less than or equal to about 500° C., such as less than or equal to about 400° C., such as less than equal or to about 300° C.

Prior to the heating and/or casting step, the composition and/or tools (e.g., mold) involved in the casting process can be at ambient temperature or can be preheated. For example, in one embodiment, at least one of (i) the alloy composition and (ii) the mold can be preheated to an elevated temperature before the commencement of the molding step. The elevated temperature can be the aforedescribed first temperature, second temperature, or any temperature in between. In one embodiment, in addition to the composition, the surface of any or all of the parts of the mold and/or the tools that will be used during the process can also be pre-heated to a temperature, such as to the first temperature. The tools can include, for example, a plunger or an instrument used for shaping, disposing, cutting, and/or polishing, such as a blade, a knife, a scrapping instrumentation, etc.

The composition can be brought to, above, or below its Tg such that the composition can be softened. Depending on the composition, the first temperature can vary, but in most embodiments it is below the Tx of the composition. As described above, the composition can also be pre-heated so that a heating step can be skipped. For example, the first temperature of the first fluid can be of any value(s) but can be below the softening temperature of the mold as described above. In one embodiment, the first temperature is less than or equal to about 500° C., such as less than or equal to about 400° C., such as less than or equal to about 300° C.

The heating can be localized heating, such that only the interfacial region between the heated alloy and the mold. For example, only the surface region of the molds or tools (e.g., shaping tools) is heated to the first temperature. The region can refer to the top 50 microns or more, such as 100 microns or more, such as 200 microns or more, such as 400 microns or more, such as 800 microns or more, such as 1 mm or more, such as 1.5 mm or more, such as 2 mm or more, such as 5 mm or more, such as 1 cm or more, such as 5 cm or more, such as 10 cm or more. Alternatively, at least substantially all of the alloy and the entire parts and shaping tools involved can be heated to the first temperature. The heating step can be carried out by any suitable techniques, such as with a laser, inductive heating, conductive heating, flash lamp, electron discharge, or combinations thereof. The heating time can depend on the chemical composition of the alloy. For example, the heating time can be less than or equal to 250 seconds, such as less than or equal to 200 seconds, such as less than or equal to 150 seconds, such as less than or equal to 100 seconds, such as less than equal to 50 seconds.

In one embodiment, shaping and/or forming can be carried out with a (mechanical) shaping pressure. The pressure can be created as a result of the different techniques used to process and dispose the composition, as described below. Depending on the application, the pressure can be applied in various ways, such as a shear pressure, a tensile pressure, a compressive pressure. For example, the pressure can help push the soften alloy composition in a recessed surface or cavity of the part so that the composition can form to the shape of the mold as it hardens (or solidifies). In one embodiment, the viscosity of an amorphous alloy in the supercooled liquid region can vary between $10^{12}$ Pa·s at Tg down to $10^5$ Pa·s at Tx, which is generally considered the high temperature limit of the supercooled region. The amorphous alloy in the supercooled region has high stability against crystallization and can exist as a highly viscous liquid. Liquids with such viscosities can undergo substantial plastic strain under an applied pressure. In contrast to solids, the liquid amorphous alloy can deform locally, which can drastically lower the required energy for cutting and forming. Thus, in one embodiment, the step of disposing can include thermoplastic forming. Thermoplastic forming can allow the application of a large deformation to the disposed interfacial layer to facilitate shaping. The ease of cutting and forming can depend on the temperature of the alloy, the mold, and the cutting tool. As temperature is increased the viscosity is reduced, allowing for easier forming.

Several techniques can be used to provide further processing during, or after, the step of disposing. Shaping or forming can refer to rendering the liquid/softened composition into a desired shape before or as it solidifies. In one embodiment, the step of molding further can include conforming, shearing, extrusion, over-molding, over-casting, or combinations thereof, in at least one operation. In one embodiment, the further process step can include separating the molded article from the mold and/or polishing the surface of the molded article. Any combination of these techniques during further processing can be carried out simultaneously in one step or in multiple sequential steps.

NON-LIMITING WORKING EXAMPLES

To investigate the effects of tin addition on the thermal properties of alloys in the Zr—Cu—Ni—Al alloy system, compositions according to the following formula:

$$Zr_{50.75-x}Cu_{36.25}Ni_4Al_9Sn_x$$

were prepared using direct arc casting into a copper mold. It was determined that a fully amorphous phase was obtained for the alloys with x in an atomic percentage from about 0 to 5.

As shown in the data plots below, the values of $T_g$ and $T_x$ shift to the right slightly, then left, and right again as more tin is added to the system. ΔT, defined as ($T_x$-$T_g$), only drops noticeably after 1.5 atomic percent of tin is added to the system. The term $\Delta H_x$ refers to the heat of crystallization of the amorphous phase measured during 20° C./min heating in a differential scanning calorimeter. $T_s$ refers to the solidus temperature—i.e., the onset of melting measured during 20° C./min heating; $T_1$ refers to the liquidus temperature—i.e., the end of melting measured during 20° C./min heating. $\Delta H_f$ refers to the heat of fusion—i.e., the total area under the melting peaks measured during 20° C./min heating Even though there were changes in $T_g$ and $T_x$, and T, the formation of an amorphous phase and the critical cooling rate of the alloy were not noticeably changed. Tin has also been introduced into the Zr—Nb—Cu—Ni—Al, Zr—Ti—Cu—Ni—Be, Zr—Ti—Nb—Cu—Be, Zr—Ti—Cu—Ni—Be and Zr—Ti—Nb—Cu—Ni—Be glass forming alloy systems with low purity constituents, and fully amorphous monolithic and in-situ composite alloys were obtained with up to 5 atomic percent of tin. The results of Sn additions to a series of Zr—Cu—Ni—Al alloys are summarized in Table 2, below. It is observed that there is an increase in the glass transition and liquidus temperatures with increasing tin, for small amount of Sn addition, particularly when the Sn is smaller or equal to about 1%. Also, there is relatively little effect on thermal stability (i.e., ΔT) for small additions of Sn. Finally, there was present an amorphous phase in 3 mm diameter rods of this alloy for Sn additions up to about 5%.

TABLE 2

Properties of Exemplary Tin-Containing Zr—Cu—Ni—Al Amorphous Alloys

| Sn Content (at %) | $T_g$ (° C.) | $T_x$ (° C.) | ΔT (° C.) | $\Delta H_x$ (J/g) | $T_s$ (° C.) | $T_l$ (° C.) | $\Delta H_f$ (J/g) |
|---|---|---|---|---|---|---|---|
| 0.0 | 413.7 | 497.3 | 83.6 | 49.44 | 746.3 | 887.3 | 161.332 |
| 0.5 | 426.2 | 509.8 | 83.6 | 57.21 | 767.9 | 890.7 | 143.984 |
| 1.0 | 430.4 | 509.9 | 79.5 | 58.64 | 713.8 | 892.3 | 147.71 |
| 1.5 | 433.9 | 499.5 | 65.6 | 63.66 | 713.4 | 894.8 | 137.109 |

TABLE 2-continued

Properties of Exemplary Tin-Containing Zr—Cu—Ni—Al Amorphous Alloys

| Sn Content (at %) | $T_g$ (° C.) | $T_x$ (° C.) | ΔT (° C.) | $\Delta H_x$ (J/g) | $T_s$ (° C.) | $T_l$ (° C.) | $\Delta H_f$ (J/g) |
|---|---|---|---|---|---|---|---|
| 2.0 | 430.5 | 493.7 | 63.2 | 54.55 | 711.3 | 898.3 | 129.23 |
| 2.5 | 428.5 | 489.5 | 61 | 50.27 | 706.1 | 901.3 | 124.592 |
| 3.0 | 432.5 | 494.4 | 61.9 | 46.07 | 708.2 | 897.4 | 133.51 |
| 3.5 | 439.4 | 501.6 | 62.2 | 42.32 | 709.5 | 966.1 | 135.32 |
| 4.0 | 442.9 | 507.8 | 64.9 | 39.76 | 711 | 937.9 | 121.33 |
| 4.5 | 445.7 | 510.6 | 64.9 | 39.28 | 712.3 | 956.9 | 117.64 |
| 5.0 | 447.9 | 513.3 | 65.4 | 39.93 | 717.1 | 971.2 | 105.45 |

Below are several embodiments that were presented as claims in the priority U.S. Provisional Application Ser. No. 61/354,620, filed Jun. 14, 2010, which is incorporated herein in its entirety by reference:

1. An amorphous alloy comprising:

$$Zr_aM_bN_cSn_d$$

wherein:

M is selected from the group consisting of one or more transition metal elements; N is one of either Al or Be; and a, b, c, and d are in atomic percentages wherein:

a is from about 30 to 70, b is from about 25 to 60, c is from about 5 to 30, and d is from about 0.1 to 5; and wherein the purity of the Zr constituent is less than 98.75%, and wherein the alloy may have a concentration of oxygen of 200 ppm while maintaining its amorphous character.

2. The amorphous alloy of Embodiment 1, wherein M is a combination of Ni and Cu, and N is Al.

3. The amorphous alloy of Embodiment 1, wherein M is a combination of Ni and Cu, and N is Be.

4. The amorphous alloy of Embodiment 1, wherein M is a combination of Ni and Cu, and N is [sic] combination of Al and Be.

5. An amorphous alloy as described in claim 1, wherein M is Cu, and N is Be.

6. The amorphous alloy of Embodiment 1, wherein M is Cu, and N is a combination of Al and Be.

7. The amorphous alloy of Embodiment 1, wherein M is a combination of Ti, Cu, Nb, and N is Be.

8. The amorphous alloy of Embodiment 1, wherein M is a combination of Ti, Nb, Cu, Ni, and N is Be.

9. An amorphous alloy as described in claim 1, wherein M is a combination of Ti, V, Cu, Ni and N is Be.

10. The amorphous alloy of Embodiment 1, wherein M is a combination of Ti, Ta, Cu, Ni and N is Be.

11. The amorphous alloy of Embodiment 1, wherein M is a combination of Ti, Mo, Cu, Ni and N is Be.

12. The amorphous alloy of Embodiment 1, wherein M is a combination of Ti, W, Cu, Ni and N is Be.

13. The amorphous alloy of Embodiment 1, wherein the purity of the Zr is less than 98.75%.

14. The amorphous alloy of Embodiment 1, wherein the amorphous alloy contains at least 200 ppm of an oxygen impurity.

15. An amorphous alloy comprising:

$$Ti_aM_bN_cSn_d$$

wherein:

M is selected from the group consisting of one or more transition metal elements; N is one of either Al or Be; and a, b, c, and d are in atomic percentages wherein:

a is from about 30 to 70, b is from about 25 to 60, c is from about 5 to 30, and d is from about 0.1 to 5, and wherein the purity of the Ti constituent is less than 98.75%, and wherein the alloy may have a concentration of oxygen of 200 ppm while maintaining its amorphous character.

16. The amorphous alloy of Embodiment 15, wherein M is a combination of Zr and V, and N is Be.

17. An amorphous alloy comprising:

$$Ti_aM_bN_cSn_d$$

wherein:

M is selected from the group consisting of one or more transition metal elements; N is at least one of Al or Be; and a, b, c, and d are in atomic percentages wherein:

a is from about 30 to 70, b is from about 25 to 60, c is from about 5 to 30, and d is from about 0.1 to 5, and wherein the purity of the Ti constituent is less than 98.75%, and wherein the alloy may have a concentration of oxygen of 200 ppm while maintaining its amorphous character.

18. A method of manufacturing an amorphous alloy comprising:

providing a feedstock comprising: $Zr_aM_bN_cSn_d$ wherein:

M is selected from the group consisting of one or more transition metal elements; N is one of either Al or Be; and a, b, c, and d are in atomic percentages, wherein:

a is from about 30 to 70, b is from about 25 to 60, c is from about 5 to 30, and d is from about 0.1 to 5, and wherein the purity of the Zr constituent is less than 98.75%, and wherein the alloy may have a concentration of oxygen of 200 ppm while maintaining its amorphous character;

heating said feedstock to a molten state; and quenching said molten feedstock to a form a solid amorphous alloy.

Electronic Devices

The aforedescribed quality control can be valuable in the fabrication process involving using BMG. Because of the superior properties of BMG, BMG can be made into structural components in a variety of devices and parts. One such type of device is an electronic device.

An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

What is claimed:

1. A composition, comprising:

an alloy that is at least partially amorphous having an amorphous content of at least 5 vol. % and is represented by a chemical formula:

$Q_aM_bN_cSn_d$ wherein:

Q is Zr, Ti, or both;

M is V;

N is Al, Be, or both; and a, b, c, and d each independently represents an atomic percentage; and a is from about 30 to 70, b is from about 25 to 60, c is from about 5 to 30, and d is from about 0.1 to about 5.

2. The composition of claim 1, wherein the alloy is at least substantially amorphous.

3. The composition of claim 1, wherein the chemical formula is $Zr_aM_bN_cSn_d$.

4. The composition of claim 1, wherein the chemical formula is $Ti_aM_bN_cSn_d$.

5. The composition of claim 1, further including Ni, Co, Cu, Nb, Ta, Mo, W, or combinations thereof.

6. The composition of claim 1, further including Ni, Cu, or both; and N is Al.

7. The composition of claim 1, further including Ni, Cu, or both; and N is Be.

8. The composition of claim 1, further including Cu, Nb, Ni, Co, Ta, Mo, or combinations thereof; and N is Be.

9. The composition of claim 1, wherein the alloy has an elastic limit of at least 1.5%.

10. The composition of claim 1, wherein the alloy has a hardness value of at least 4.0 GPa.

11. The composition of claim 1, wherein the alloy has a fracture toughness of at least 20 MPa√m.

12. A method of making an alloy, comprising:

heating a mixture of the alloy at a first temperature above a glass transition temperature Tg of the alloy, the mixture comprising elements Q, M, N, Sn;

quenching the mixture to a second temperature below the Tg of the alloy to form the alloy that is at least partially amorphous having an amorphous content of at least 5 vol. % and is represented by a chemical formula:

$Q_aM_bN_cSn_d$ wherein:

Q is Zr, Ti, or both;

M is V;

N is Al, Be, or both;

a, b, c, and d each independently represents an atomic percentage; and:

a is from about 30 to 70, b is from about 25 to 60, c is from about 5 to 30, and d is from about 0.01 to 5.

13. The method of claim 12, wherein the Q in the mixture has a purity of 99% or less as a raw material.

14. The method of claim 12, further comprising heating the mixture to the first temperature.

15. The method of claim 12, wherein the first temperature is above a melting temperature of the alloy.

16. The method of claim 12, wherein a is from about 40 to 70; b is from about 25 to 60; c is from about 5 to 30; and d is from about 0.5 to 4.5.

17. The method of claim 12, further including Ni, Cu, Nb, Ta, Mo, W, or combinations thereof.

18. The method of claim 12, further including a combination of Ni and Cu, and N is a combination of Al and Be.

19. A method of making an alloy, comprising:

heating a mixture of the alloy at a first temperature above a glass transition temperature Tg of the alloy, the mixture comprising elements Zr, Cu, Ni, Sn;

quenching the mixture to a second temperature below the Tg of the alloy to form the alloy that is at least partially amorphous having an amorphous content of at least 5 vol. % and is represented by a chemical formula:

$Zr_{50.75-x}Cu_{36.25}Ni_4Al_9Sn_x$, wherein x represents an atomic percentage and x is from about 0.01 to 5.

20. A composition, comprising:

an alloy having an amorphous content of at least 5 vol. % and is represented by a chemical formula:

$Zr_{50.75-x}Cu_{36.25}Ni_4Al_9Sn_x$, wherein x represents an atomic percentage and x is from about 0.01 to 5.

* * * * *